US005250226A

United States Patent [19]

Oswal et al.

[11] Patent Number: 5,250,226

[45] Date of Patent: Oct. 5, 1993

[54] ELECTRICAL DEVICES COMPRISING CONDUCTIVE POLYMERS

[75] Inventors: Ravinder K. Oswal, Union City; Amitkumar N. Dharia, Newark; Leonard Barrett, Union City, all of Calif.

[73] Assignee: Raychem Corporation, Menlo Park, Calif.

[21] Appl. No.: 202,165

[22] Filed: Jun. 3, 1988

[51] Int. Cl.[5] ..... H01B 1/00

[52] U.S. Cl. ..... 252/500

[58] Field of Search ..... 252/511, 502, 512, 500; 524/495, 496; 338/22 R

[56] References Cited

U.S. PATENT DOCUMENTS

| | | | |
|---|---|---|---|
| 3,858,144 | 12/1974 | Bedard et al. | 338/22 R |
| 3,861,029 | 1/1975 | Smith-Johannsen et al. | 29/611 |
| 4,177,376 | 12/1979 | Horsma et al. | 219/553 |
| 4,286,376 | 9/1981 | Smith-Johannsen et al. | 29/611 |
| 4,330,703 | 5/1982 | Horsma et al. | 219/553 |
| 4,388,607 | 6/1983 | Toy et al. | 338/22 SD |
| 4,426,339 | 1/1984 | Kamath et al. | 264/22 |
| 4,514,620 | 4/1985 | Cheng et al. | 219/553 |
| 4,534,889 | 8/1985 | van Konynenburg et al. | 252/511 |
| 4,543,474 | 9/1985 | Horsma et al. | 219/553 |
| 4,560,498 | 12/1985 | Horsma et al. | 252/511 |
| 4,624,990 | 11/1986 | Lunk et al. | 525/199 |
| 4,629,869 | 12/1986 | Bronvall | 219/553 |
| 4,654,511 | 3/1987 | Horsma et al. | 219/548 |
| 4,658,121 | 4/1987 | Hormsa et al. | 219/553 |
| 4,668,857 | 5/1987 | Smuckler | 219/549 |
| 4,774,024 | 9/1988 | Deep et al. | 252/511 |
| 4,849,133 | 7/1989 | Yoshida et al. | 252/511 |
| 4,857,880 | 8/1989 | Au et al. | 338/22 R |
| 4,866,253 | 9/1989 | Kamath et al. | 219/548 |
| 4,910,389 | 3/1990 | Sherman et al. | 219/548 |
| 4,980,341 | 12/1990 | Shafe et al. | 219/548 |

FOREIGN PATENT DOCUMENTS

| | | |
|---|---|---|
| 0040537 | 11/1981 | European Pat. Off. . |
| 138424 | 4/1985 | European Pat. Off. . |
| 235454 | 9/1987 | European Pat. Off. . |

OTHER PUBLICATIONS

Edmund F. Jordan et al, "Side-Chain Crystallinity. I. Heats of Fusion and Melting Transitions on Selected Homopolymers Having Long Side Chains", Journal of Polymer Science: Part A-1, vol. 9, 1835-1852 (1971).

Edmund F. Jordan et al, "Side-chain Crystallinity. II. Heats of Fusion and Melting Transitions on Selected Copolymers Incorporating n-Octadecyl Acrylate or Vinyl Stearate", Journal of Polymer Science: Part A-1, vol. 9, 3349-3365 (1971).

Edmund F. Jordan, "Side-Chain Crystallinity. III. Influence of Side-chain Crystallinity on the Glass Transition Temperatures of Selected Copolymers Incorporating n-Octadecyl Acrylate or Vinyl Stearate", Journal of Polymer Science: Part A-1, vol. 9, 3367-3378 (1971).

William S. Port et al, "Polymerizable Derivatives of Long-Chain Fatty Acids. VII. Copolymerization of Vinyl Acetate with Some Long-Chain Vinyl Esters", Journal of Polymer Science, vol. IX, No. 6, 493-502 (1952).

*Primary Examiner*—Mark L. Bell
*Assistant Examiner*—A. Wright
*Attorney, Agent, or Firm*—Marguerite E. Gerstner; Timothy H. P. Richardson; Herbert G. Burkard

[57] ABSTRACT

Conductive polymer compositions which exhibit PTC behavior comprising a first polymeric component which may be crystalline, a second component, and a particulate conductive filler. The second component may comprise either a polymer which exhibits side chain crystallization or a crystalline material which has a sharp melting point and has poor physical properties at room temperature and/or exhibits no melt strength at elevated temperatures. The compositions are particularly useful in electrical devices which exhibit "square" resistance vs. temperature characteristics.

24 Claims, 1 Drawing Sheet

ELECTRICAL DEVICES COMPRISING CONDUCTIVE POLYMERS

BACKGROUND OF THE INVENTION

Field of the Invention

This invention relates to conductive polymer compositions and electrical devices comprising them, in particular conductive polymers which comprise at least one component which has side-chain crystallization.

Background of the Invention

Self-regulating heaters and other electrical devices comprising conductive polymers are well-known. Reference may be made, for example to U.S. Pat. Nos. 3,858,144, 3,861,029, 4,177,376, 4,286,376, 4,330,703, 4,388,607, 4,426,339, 4,514,620, 4,534,889, 4,560,498, 4,654,511, and 4,658,121, and copending, commonly assigned application Ser. No. 75,929 filed Jul. 21, 1987 (Barma et al.), now U.S. Pat. No. 5,106,540, issued Apr. 21, 1992, the disclosures of which are incorporated herein by reference. By virtue of a PTC (positive temperature coefficient of resistance) anomaly, such heaters allow temperature control over a narrow temperature range, providing "automatic" shutdown in the event of exposure to overtemperature or overvoltage conditions or "automatic" heating when exposed to a colder environment.

Self-regulating heaters in the form of elongate strips with embedded electrodes are commonly used as heaters for pipes containing water, oil, or other fluids or materials. Such heaters are flexible so that they may be wrapped around pipes and valves. Their construction produces a parallel electrical circuit, allowing them to be cut to the appropriate length for each application. The control temperature of these strip heaters is dependent on the melting point, $T_m$, of the polymer matrix in the conductive polymer. Under ideal conditions, the curve of resistivity as a function of temperature (the "R(T) curve") for such polymers is "square", i.e. the resistivity is relatively constant at temperatures below $T_m$ and increases rapidly at a temperature approximating $T_m$. However, most crystalline polymers do not have sharp melting points, but melt over a range of temperatures and, when blended with a conductive filler such as carbon black to produce a conductive material with an appropriate resistivity for use as a heater, generate R(T) curves which are not square, but have a relatively gradual increase in resistivity in the temperature range surrounding $T_m$. As a result, the heater tends to shutoff or "switch" at a temperature $T_s$ which is usually close to $T_m$ but may be well below $T_m$. (The switching temperature, $T_s$, is defined as the temperature at the intersection point of extensions of the substantially straight portions of a plot of the log of the resistance of a PTC element against temperature which lie on either side of the portion showing the sharp change in slope.) This means that in order to generate adequate heat for routine applications such as freeze protection and process temperature control, heaters must utilize polymers with a $T_m$ significantly higher than the actual temperature required to do the job. For example, polymers with a $T_m$ of about 85° C. are used for freeze protection, even though, with adequate thermal insulation, a polymer with a melting point slightly higher than 0° C. and a square R(T) curve would theoretically be sufficient. Gradual R(T) curves frequently make it advisable that thermostats be used in conjunction with the strip heaters in order to limit overheating and possible damage to substrates and/or components.

An additional problem with heaters which do not have "square" R(T) curves is inrush current, i.e. the current that is observed immediately after powering the heater and before the heater reaches an equilibrium state. If the R(T) curve is not square, the resistance at ambient temperature may be significantly (e.g. 10 times) less than the resistance at $T_s$. As a result, the heater will draw a higher current at ambient temperature, immediately after powering, than it will draw just below $T_s$. The electric circuitry, e.g. circuit breakers, associated with the heater must be selected to accommodate the high inrush current, resulting in increased expense. If the R(T) curve is square, the problem of inrush current is decreased. In addition, square R(T) curves result in relatively square power vs. temperature (P(T)) curves, a factor which enables longer circuit lengths for elongate devices such as strip heaters which may require start-up at low temperatures. Electrical devices with square P(T) curves have a relatively constant power output at temperatures up to that of $T_s$.

Proposals for generating square R(T) curves have been made. U.S. Pat. No. 4,177,376 (Horsma, et al.) and its related cases, U.S. Pat. Nos. 4,330,703, 4,543,474, and 4,654,511, disclose self-regulating heating articles in which a layer which exhibits ZTC (zero temperature coefficient of resistance) behavior is contiguous to a layer which exhibits PTC behavior. When powered, current flows through at least part of the thickness of the PTC layer and through the ZTC layer. When the resistances of the two layers are appropriately selected, the R(T) curve of the heater will be a combination of the best features of both layers, producing a flat region corresponding to the ZTC material below $T_m$ and a steeply increasing region at $T_m$ corresponding to the PTC material. Heaters based on this concept require two compositions and, in some applications, complex configurations.

Polymers with melting temperatures that correspond more closely to the desired control temperature for the application have also been considered. For example, U.S. Pat. No. 4,514,620 (Cheng, et al.) discloses conductive polymers which are based on polyalkenamers, crystalline organic polymers which have melting temperatures of less than about 100° C. When used in heaters, these polymers had R(T) curves which were very gradual.

SUMMARY OF THE INVENTION

We have now found that conductive polymer compositions which have adequate PTC anomalies, acceptable physical properties, and relatively square R(T) curves with flat slopes below $T_m$ and a PTC anomaly over a narrow temperature range can be made by the addition of a component which itself has a relatively high crystallinity, but which cannot be processed by itself to produce a composite material with acceptable physical properties. Thus, in one aspect, the invention discloses a PTC composition which comprises (1) a first polymeric component which comprises a crystalline organic polymer which has a melting point $T_{m1}$;

(2) a second polymeric component which exhibits side chain crystallization and has a melting point $T_{m2}$; and (3) a particulate conductive filler.

In a second aspect the invention discloses a PTC composition which comprises (1) a first polymeric component which comprises an organic polymer;

(2) a second component which (i) has a crystallinity of at least 10%, (ii) has a sharp melting temperature $T_{m2}$, and (iii) when exposed to temperatures above $T_{m2}$, has no melt strength; and (3) a particulate conductive filler.

In a third aspect the invention discloses an electrical device which comprises (1) a PTC element which is composed of a conductive polymer composition as defined in the first or second aspect of the invention; and (2) at least two electrodes which can be connected to a source of electrical power to cause current to flow through the PTC element.

DETAILED DESCRIPTION OF THE INVENTION

Figure 1:
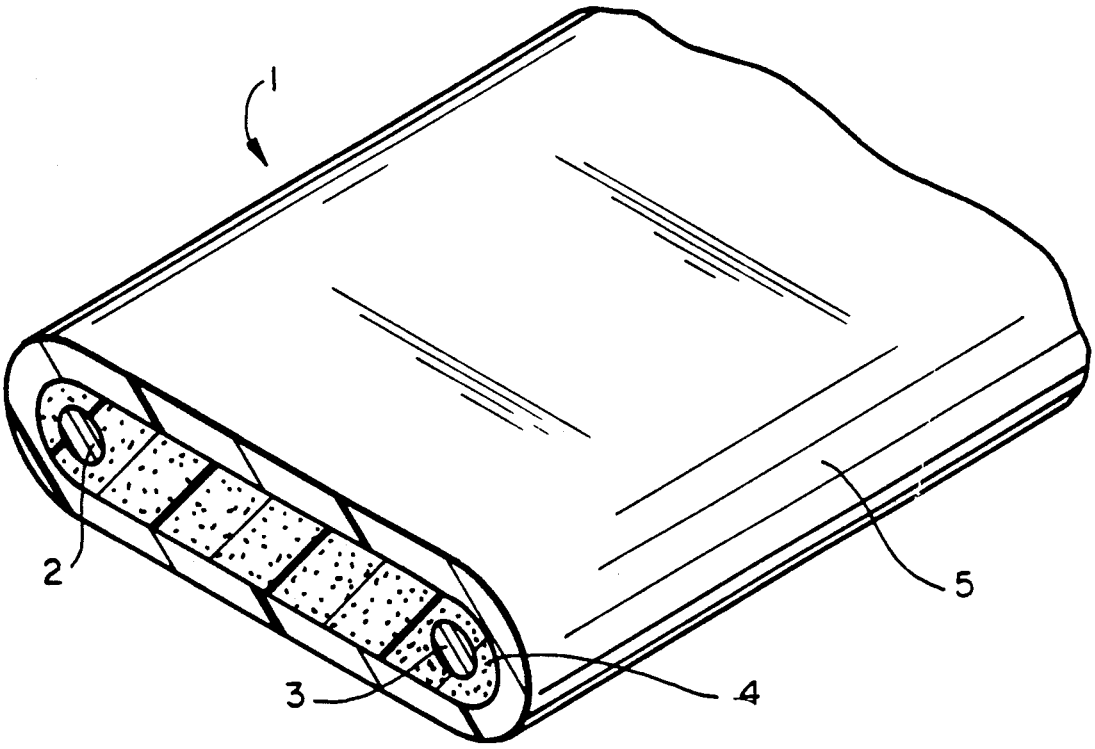
FIG. 1 is a plan view of an electrical device made in accordance with the invention.

The conductive polymer compositions of this invention exhibit PTC behavior. The terms "PTC anomaly" and "composition exhibiting PTC behavior" are used in this specification to denote a composition which has an $R_{14}$ value of at least 2.5 or an $R_{100}$ value of at least 10, and preferably both, and particularly one which has an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. In contrast, "ZTC behavior" is used to denote a composition which increases in resistivity by less than 6 times, preferably less than 2 times in any 30° C. temperature range within the operating range of the heater.

The conductive polymer composition comprises a first polymeric component which may be an organic polymer (such term being used to include siloxanes), preferably a crystalline organic polymer, an amorphous thermoplastic polymer (such as polycarbonate or polystyrene), an elastomer (such as polybutadiene or ethylene/propylene/diene (EPDM) polymer) or a blend comprising at least one of these. Suitable crystalline polymers include polymers of one or more olefins, particularly polyethylene; copolymers of at least one olefin and at least one monomer copolymerisable therewith such as ethylene acrylic acid, ethylene ethyl acrylate, and ethylene vinyl acetate; melt-shapeable fluoropolymers such as polyvinylidene fluoride and ethylene tetrafluoroethylene; and blends of two or more such crystalline polymers.

When the conductive polymer composition is to be used in electrical devices intended for low temperature applications such as freeze protection or body warming, crystalline organic polymers comprising polyalkenamers are preferred as the first polymeric component. Suitable materials are disclosed in U.S. Pat. No. 4,514,620 (Cheng, et al.). Polyalkenamer is the general term for polymers with ethylenically unsaturated repeating units which are derived from cycloolefins. Suitable polymers comprise at least 15% by weight, preferably at least 25% by weight, particularly at least 50% by weight of repeating units derived from a cycloolefin. Although polymers produced from cycloolefins with 5 to 12 carbon atoms in the ring may be used, it is preferred to use a polymer of cyclooctenamer, i.e. a material with 8 carbon atoms in the ring. These preferred polymers have a crystalline melting point of 0° to 80° C., preferably 10° to 75° C., particularly 20° to 50° C. (The melting point, $T_m$, is defined as the temperature at the peak of a differential scanning calorimeter (DSC) curve measured on the polymer.) Particularly good results have been obtained using polyoctenamer with a trans content of 55 to 90% and a corresponding cis content of 45 to 10%.

If the first polymeric component is a crystalline organic polymer it is preferred that the crystallinity be at least 5%, preferably at least 8%, particularly at least 10%, especially at least 12%, e.g. 12 to 40%.

The second component may be an organic polymer or other suitable material or a blend of two or more materials. Suitable materials are those which exhibit a high degree of crystallinity, i.e. a crystallinity of at least 20%, preferably at least 30%, particularly at least 40%, especially at least 50%. In addition, most suitable materials have a sharp melting temperature, $T_{m2}$, where $T_{m2}$ is the peak temperature of a DSC curve. This means that the temperature range from the start of melting to the completion of melting as determined from a DSC curve is less than 30° C., preferably less than 20° C., particularly less than 15° C., especially less than 10° C. For ease of processing and to avoid degradation of the polymeric components during mixing, particularly when melt processing is used, the melting temperature $T_{m2}$ is preferably within the range $(T_{m1}-150)$°C. to $(T_{m1}+50)$°C., particularly within the range $(T_{m1}-100)$°C. to $(T_{m1}+30)$°C., especially within the range $(T_{m1}-50)$°C. to $(T_{m1}°+20)$°C. By selecting components that fall within this range, the ability of the second component to improve the "squareness" of the R(T) curve in terms of both the flat slope below $T_m$ and the sharpness of the PTC anomaly is maximized. The extent of this improvement may be determined by comparing the temperatures at which the resistance at 0° C. increases by 10 times (10×) and by 100 times (100×). The smaller the difference in temperatures, the sharper and more "square" the R(T) curve.

Materials comprising the second component normally have poor physical properties, e.g. brittleness, at room temperature and have little or no melt-strength at temperatures of $T_{m2}$ or greater, forming an oil or degrading. As a result they cannot be processed by traditional means such as melt processing to produce useful composite materials. These materials have a weight average molecular weight of at least $5\times10^4$, preferably at least $8\times10^4$, particularly at least $1\times10^5$.

Materials which are particularly suitable as the second component for compositions of this invention are those polymers which exhibit side chain crystallization. Such materials tend to have adequate crystallinity, suitable melting points, and suitably sharp melting characteristics. Preferred materials are vinyl polymers which have a linear side chain comprising at least eight carbon atoms, preferably at least ten carbon atoms, particularly at least twelve carbon atoms, especially at least 16 carbon atoms, e.g. sixteen to eighteen carbon atoms. One particularly preferred form of vinyl polymer is that in which the polymeric component or the side chain is a vinyl ester of a fatty acid. Poly(vinyl stearate) with a melting point of approximately 30° to 50° C. is particularly useful. Its high weight average molecular weight (approximately $1\times10^5$) serves to prevent surface "blooming" once the polyvinyl stearate is incorporated into the first polymeric component.

The second component is present in the composition in an amount less than 40% by weight, preferably less than 30% by weight, particularly less than 20% by weight, especially less than 15% by weight, e.g. less than 10% by weight. The required quantity of the second component is dependent on the nature of the first polymeric component and the desired R(T) characteristic and/or resistivity of the conductive composition. Many suitable organic polymers which have side chain crystallization have traditionally been used in low concentrations (e.g. less than about 2% by weight) as lubricants for polymeric compositions. In compositions of this invention such materials are present in an amount of at least 5% by weight, preferably at least 7% by weight. In most compositions, the ratio of the first polymeric component to the second component is in the range 10:1 to 2:1.

The particulate conductive filler may be carbon black, graphite, metal, metal oxide, or a combination of these. Particularly suitable carbon blacks are those which have a particle size (D) of 20 to 250 millimicrons and a surface area (S) such that the ratio S/D is not more than 10. Particularly preferred are carbon blacks which have a particle size in the range of 30 to 60 millimicrons, e.g. about 40 millimicrons. The conductive filler is present in the composition in an amount suitable for achieving the desired resistivity, normally 10 to 50% by weight of the composition, preferably 15 to 40% by weight, particularly 20 to 30% by weight.

Alternatively, the conductive filler may itself comprise a conductive polymer. In this case, a particulate conductive filler is distributed in a polymer matrix and the matrix is then ground into particles. Such materials are described in copending commonly assigned U.S. application Ser. Nos. 818,846 filed Jan. 14, 1985 (Barma) now abandoned and 75,929 filed Jul. 21, 1987 (Barma, et al.), now U.S. Pat. No. 5,106,540, the disclosures of which are incorporated herein by reference.

The conductive polymer composition may also comprise inert fillers, antioxidants, flame retardants, prorads, stabilizers, dispersing agents, or other components. Such components may include fillers which are themselves conductive, but which are present at relatively low loadings and have little effect on the resistivity of the composition. Suitable inert fillers include metal oxides such as zinc oxide, aluminum oxide, titanium oxide, magnesium oxide, or other materials such as magnesium hydroxide, calcium carbonate and alumina trihydrate. Such inert fillers may be present in an amount less than 50% by weight, preferably less than 40% by weight, particularly less than 30% by weight, especially less than 25% by weight of the composition. Highly reinforcing inert fillers, e.g. silica, may be present in an amount less than 10%, preferably less than 8%, e.g. 3–5%, to stiffen the composition for particular applications, e.g. to minimize compression. Preferred antioxidants are those which have a melting point below the temperature at which the conductive polymer composition is processed. Mixing may be conducted by any suitable method, e.g. solvent blending, although melt-processing is preferred. It is preferable that the processing temperature during melt-processing not exceed the degradation temperature of either the first or second components. For example, compositions comprising PVS should be meltprocessed at less than 190° C. Solvent blending may be preferred if degradation is a problem. Depending on the components, the compositions may require quenching from the melt in order to produce appropriate levels of crystallinity and/or acceptable physical properties.

The conductive polymer composition may be crosslinked by irradiation or chemical means. Although the particular level of crosslinking is dependent on the polymeric components and the application, normal crosslinking levels are equivalent to that achieved by an irradiation dose in the range of 2 to 50 Mrads, preferably 3 to 30 Mrads, e.g. 10 Mrads.

The conductive polymer composition of the invention may be used in a PTC element as part of an electrical device, e.g. a heater, a sensor, or a circuit protection device. The resistivity of the composition is dependent on the dimensions of the PTC element and the power source to be used. For circuit protection devices which may be powered from 15 to 600 volts, the conductive polymer composition preferably has a resistivity at 0° C. of 0.01 to 100 ohm-cm. For electrical devices suitable for use as heaters powered at 6 to 60 volts DC, the resistivity at 0° C. of the composition is preferably 10 to 1000 ohm-cm; when powered at 110 to 240 volts AC, the resistivity at 0° C. is preferably about 1000 to 10,000 ohm-cm. Higher resistivities are suitable for devices powered at voltages greater than 240 volts AC.

The PTC element may be of any shape, depending on the application. Circuit protection devices and laminar heaters frequently comprise laminar PTC elements, while strip heaters may be rectangular, elliptical, or dumbell-("dogbone-") shaped. Appropriate electrodes, suitable for connection to a source of electrical power, are selected depending on the shape of the PTC element. Electrodes may comprise metal wires or braid, e.g. for attachment to or embedment into the PTC element, or they may comprise metal sheet, metal mesh, conductive (e.g. metal- or carbon-filled) paint, or any other suitable material. For improved adhesion, the electrodes may be preheated during attachment to the PTC element or they may be coated with a conductive adhesive layer.

The PTC element is frequently covered with a dielectric layer for electrical insulation and environmental protection. Such layers may comprise a layer of polymer (e.g. for heaters) or epoxy (e.g. for circuit protection devices).

FIG. 1 is a plan view of a strip heater 1 prepared in accordance with the invention. Metal electrodes 2,3 are surrounded by a conductive polymer composition 4. An insulating polymeric jacket 5 surrounds the strip heater.

The invention is illustrated by the following examples.

EXAMPLE 1

Using a Henschel mixer, 21 weight percent (wt %) zinc oxide (XX-631, available from New Jersey Zinc), 10 wt % polyvinyl stearate containing 10% vinyl stearate monomer (PVS, available from Speciality Polymers), 27 wt % carbon black (Sterling SO, available from Cabot), and 2 wt % antioxidant (Irganox 1076, available from Ciba-Geigy) were dry-blended. One-half of 40 wt % polyoctenamer (Vestenamer 6213, available from Huls) was melted in a Banbury mixer before adding the filler mixture and the second half of the polymer. The compound was mixed, dumped, extruded through a strand die, and chopped into pellets. A strip heater was made by extruding the pellets around two preheated 16 AWG strand nickel-copper conductors which had been coated with a graphite emulsion (Aquadag E, available from Acheson Colloids). The extrudate was quenched in cold water. The resulting heater had a dumbell-shaped profile with a web thickness of about 0.070 to 0.080 inch (0.178 to 0.203 cm) and an electrode spacing of about 0.320 inch (0.812 cm). The heater was jacketed with a 0.02 inch (0.05 cm) thick layer of a polyolefin blend and was then irradiated to 3 Mrad using a 1.5 MeV electron beam.

EXAMPLES 2-10

For each polymer listed in Table I, two formulations were prepared following the procedure described in Example 1. One formulation comprised the polymer, carbon black, and suitable antioxidants and/or fillers. The second formulation comprised the same materials with the addition of poly(vinyl stearate) (PVS). Each composition was compression molded into a plaque with a geometry 6 by 1 by 0.070 inches (15.24 by 2.54 by 0.18 cm). Silver paint electrodes (Electrodag 504, available from Acheson Colloids) were painted at the edges of the plaque so that electrical connection could be made.

R(T) curves were determined for each composition by measuring the resistance at various temperatures. Presented in Table I are the percent by weight of PVS in each formulation, the resistance of each formulation measured at 0° C., the temperature at which each formulation had an increase in resistance of 10 times and 100 times its initial 0° C. value (10× and 100× columns, respectively), the ratio of the resistance at 54° C. to that at 0° C. ($R_{54}/R_0$ column) which is an indication of the height of the PTC anomaly at 54° C. (130° F.), and the slope of the R(T) curve for each formulation defined as the ratio of the resistance at 0° C. to that at −34° C. The lower the value of the slope, the more square the R(T) curve.

TABLE I

| Example | Polymer | Wt % PVS | Resistance 0° C. (ohms) | T at 10 × (°C.) | T at 100 × (°C.) | $R_{54}/R_0$ | Slope |
|---|---|---|---|---|---|---|---|
| 2 | Kynar | 0 | 544 | 54 | 80 | 12 | 1.30 |
| | 9301 | 13.6 | 45 | 39 | 42 | 420 | 1.08 |
| 3 | Vestenamer | 0 | 600 | 29 | 36 | $>10^6$ | 1.86 |
| | 8012 | 23.5 | 1,276 | 32 | 37 | $>10^6$ | 1.19 |
| 4 | Alathon | 0 | 171 | 130 | 140 | 2 | 1.17 |
| | 7050 | 23.5 | 609 | 45 | 57 | 80 | 1.07 |
| 5 | Evaflex | 0 | 1,940 | 25 | 38 | 770 | 1.37 |
| | A709 | 35.0 | 33,100 | 31 | 39 | 20,000 | 1.43 |
| 6 | Elvax | 0 | 887 | 31 | 42 | 5,000 | 1.26 |
| | 250 | 35.0 | 695 | 27 | 34 | 40,000 | 1.73 |
| 7 | Kynar | 0 | 25,800 | 88 | 105 | 1.8 | 1.00 |
| | 460 | 13.6 | 750,000 | 30 | 34 | $>10^6$ | 1.28 |
| 8 | Tefzel | 0 | 650 | 182 | 207 | 1.3 | 1.00 |
| | 280 | 14.7 | 3,300 | 31 | 38 | 210 | 1.26 |
| 9 | Dai-el | 0 | 911 | 149 | 190 | 1.3 | 1.00 |
| | T-530 | 13.5 | 10,880 | 33 | 39 | $>10^6$ | 1.19 |
| 10 | Vestenamer | 0 | 600 | 13 | 23 | 1,000 | 4.86 |
| | 6213 | 37.0 | 461 | 37 | 43 | 120 | 1.30 |

Notes

Kynar 9301 is a terpolymer of vinylidene fluoride, hexafluoropropylene, and tetrafluoroethylene with a melting point of 90° C., available from Pennwalt.

Vestenamer 8012 is polyoctenamer with a trans content of 80% and a melting point of 55° C., available from Huls.

Alathon 7050 is high density polyethylene with a melting point of about 135° C. available from DuPont.

Evaflex A709 is ethylene ethyl acrylate copolymer with a melting point of 63° C., available from DuPont Japan.

Elvax 250 is a ethylene vinyl acetate copolymer with a vinyl acetate content of about 27% and a melting point of 70.5° C., available from DuPont.

Kynar 460 is polyvinylidene fluoride with a melting point of 160° C., available from Pennwalt.

Tefzel 280 is ethylene tetrafluoroethylene copolymer with a melting point of 260° C., available from DuPont.

Dai-el T-530 is a thermoplastic fluoroelastomer with a melting point of 250° C., available from Daikin.

Vestenamer 6213 is polyoctenamer with a trans content of 62% and a melting point of 23° C., available from Huls.

What is claimed is:

1. A conductive polymer composition which exhibits PTC behavior and which comprises (1) a first polymeric component which comprises a crystalline organic polymer which (i) has a melting point $T_{m1}$, and (ii) has a crystallinity of at least 10%.

(2) a second polymeric component which (i) exhibits side chain crystallization, (ii) has a melting point $T_{m2}$ which is within the range $(T_{m1}-150)$°C. to $(T_{m1}+50)$°C., and (iii) comprises a vinyl polymer having a linear side chain comprising at least eight carbon atoms; and (3) a particulate conductive filler.

2. A composition according to claim 1 wherein the linear side chain comprises 10 to 18 carbon atoms.

3. A composition according to claim 1 wherein the second polymeric component has a weight average molecular weight of at least $5\times10^4$.

4. A composition according to claim 3 wherein the second polymeric component has a weight average molecular weight of at least $8\times10^4$.

5. A composition according to claim 4 wherein the second polymeric component has a weight average molecular weight of at least $1\times10^5$.

6. A composition according to claim 1 wherein the second polymeric component comprises the polymer of a vinyl ester of a fatty acid.

7. A composition according to claim 6 wherein the second polymeric component comprises poly(vinyl stearate).

8. A composition according to claim 7 wherein the poly(vinyl stearate) has a melting temperature between 30° and 50° C.

9. A composition according to claim 1 wherein the first polymeric component has a crystallinity of at least 5%.

10. A composition according to claim 9 wherein the first polymeric component comprises at least 15% by weight of repeating units derived from a cycloolefin.

11. A composition according to claim 10 wherein the first polymeric component comprises at least 50% by weight of repeating units derived from a cycloolefin.

12. A composition according to claim 10 wherein the first polymeric component comprises a polymer of cyclooctenamer having a trans content of 55 to 90%.

13. A composition according to claim 1 wherein the first polymeric component has a melting point in the range of 0° to 80° C.

14. A composition according to claim 13 wherein the first polymeric component has a melting point in the range of 20° to 50° C.

15. A composition according to claim 1 wherein the conductive filler comprises carbon black.

16. A composition according to claim 15 wherein the carbon black has a particle size (D) of 20 to 250 millimicrons and a surface area (S) such that the ratio S/D is not more than 10.

17. A composition according to claim 1 wherein the second polymeric component comprises not more than 15% by weight of the composition.

18. A composition according to claim 1 wherein $T_{m2}$ is within the range $(T_{m1}-150)$°C. to $(T_{m1}+50)$°C.

19. A composition according to claim 1 which comprises (4) an inorganic particulate filler.

20. A composition according to claim 21 wherein the inorganic filler is zinc oxide and it is present in an amount not more than 30% by weight of the composition.

21. A conductive polymer composition which exhibits PTC behavior and which comprises (1) a first polymeric component which comprises an organic polymer;

(2) a second component which (i) has a crystallinity of at least 10%, (ii) has a sharp melting point $T_{m2}$ such that the temperature range from the start of melting to the completion of melting as determined from a DSC curve is less than 30° C., and (iii) when exposed to temperatures above $T_{m2}$ has no melt strength, and (iv) comprises a vinyl polymer having a linear side chain comprising at least eight carbon atoms; and (3) a particulate conductive filler;

the ratio of the first polymeric component to the second component being 10:1 to 2:1.

22. A composition according to claim 21 wherein the first polymeric component is an elastomer.

23. A composition according to claim 21 wherein the first polymeric component is a crystalline organic polymer which has a melting temperature $T_{m1}$.

24. A composition according to claim 21 wherein the first polymeric component is an amorphous thermoplastic polymer.

* * * * *

UNITED STATES PATENT AND TRADEMARK OFFICE

CERTIFICATE OF CORRECTION

PATENT NO. : 5,250,226

DATED : October 5, 1993

INVENTOR(S) : Oswal et al

It is certified that error appears in the above-indentified patent and that said Letters Patent is hereby corrected as shown below:

Claim 19, line 1 (Column 10, line 1), after "which", insert --further--.

Claim 20, line 1 (Column 10, line 4), replace "21" by --19--.

Signed and Sealed this

Third Day of May, 1994

Bruce Lehman

*Attest:*

BRUCE LEHMAN

*Attesting Officer*

*Commissioner of Patents and Trademarks*